United States Patent [19]

Hanson

[11] 3,987,893

[45] Oct. 26, 1976

[54] DISPLAY CARTON AND BLANK THEREFOR

[75] Inventor: Wallace E. Hanson, Hampden, Mass.

[73] Assignee: Champion International Corporation, Stamford, Conn.

[22] Filed: Jan. 22, 1976

[21] Appl. No.: 651,543

[52] U.S. Cl. ..... 206/45.14; 206/45.31; 206/315 B; 206/491

[51] Int. Cl.[2] ..... B65D 5/50; B65D 85/30

[58] Field of Search ..... 206/45.14, 45.31, 45.33, 206/45.34, 315 R, 315 B, 418, 491; 229/39 B; 150/52 B; 190/51

[56] References Cited

UNITED STATES PATENTS

| | | | |
|---|---|---|---|
| 3,123,204 | 3/1964 | Baker et al. | 150/52 A |
| 3,202,340 | 8/1965 | Johnston | 206/315 |
| 3,337,033 | 8/1967 | Cote | 229/39 B |
| 3,734,397 | 5/1973 | Cote | 206/45.14 |
| 3,815,735 | 6/1974 | Cucuo | 206/455 |

FOREIGN PATENTS OR APPLICATIONS

| | | | |
|---|---|---|---|
| 966,033 | 12/1970 | United Kingdom | 206/45.14 |
| 1,192,083 | 5/1970 | United Kingdom | 206/45.14 |
| 1,335,729 | 10/1973 | United Kingdom | 206/45.14 |
| 1,174,044 | 12/1969 | United Kingdom | 206/45.31 |
| 1,280,819 | 7/1972 | United Kingdom | 229/39 B |
| 1,340,704 | 12/1973 | United Kingdom | 206/45.31 |

*Primary Examiner*—Stephen P. Garbe
*Assistant Examiner*—Bruce H. Bernstein
*Attorney, Agent, or Firm*—Evelyn M. Sommer

[57] ABSTRACT

A one-piece paperboard blank for erection into a display carton capable of supporting an article, such as an inflatable basketball, football, etc., in a manner that opposed surfaces of the article are exposed includes solid top, bottom, and side panels, while the back panel is defined by specially curved portions articulated to the top and bottom panels, and lock panels articulated to the side panels, with the lock panels and the curved panels being interconnected by intermediate articulated webbed corners. The open front panel includes a top concavely curved front portion which is articulated to the top panel, as well as to articulated pairs of cushion flaps, extending from said first and second side panels. Another pair of articulated cushion flaps secured respectively to the first and second side panels cooperates with lower foldable front portions so as to provide a peripheral support for the article. The peripheral supports of the front and rear panels of the carton provide a suspended peripheral support for the article, and enable the front and rear portions of the article to be exposed.

11 Claims, 11 Drawing Figures

DISPLAY CARTON AND BLANK THEREFOR

The subject invention relates to a display carton, and a carton blank, for the display of goods, such as inflatable sporting goods. More particularly, the subject display carton is particularly adapted for shipping and displaying inflatable sports equipment, such as basketballs, footballs, soccer balls, etc. For such devices, it is important that the display carton provide protection for the article during shipment, and while at the point of purchase provide visibility of the product and also multi-stacking of the cartons, if desired.

Heretofore, display cartons for basketballs, for example, have been of a simple box type wherein the inflated diameter of the basketball corresponds to the internal dimensions of the box or cube. As is readily apparent, no portion of the basketball is visible, which is not particularly desirable, at the display point of purchase. Another form of conventional carton for basketballs includes partially open front and rear panels so as to expose opposed surfaces of the basketball, with the remainder of the carton being dimensioned to the inflated diameter of the basketball. As is readily apparent, upon a loss of inflation of the basketball, the basketball tends to move around within the carton, which affects the multi-stacking capability of the carton.

It is an object of the subject invention to overcome the shortcomings of the prior art device and provide in a single carton, and in a single carton blank, the capability of providing protection for an inflatable basketball during shipment and provide at the display point of purchase, both good visibility of the product, and multi-stacking capability, if desired. It is of importance to provide the advantage of a carton which provides protection during shipment, and to this end, the subject invention provides an arrangement wherein the basketball is firmly held by inwardly extending flaps, is cushioned, and is protected against movement and scuffing. The subject invention provides a carton which effectively suspends the basketball within the carton, while at the same time providing front and rear visibility of the basketball. The subject carton also provides for the orderly display of the product, as well as good visibility of the basketball. Due to the construction of the subject carton, the carton will stand and hold firmly the basketball with a tolerance in the inflation rate of the basketball, usually on the order of three-quarters of an inch in diameter. The suspension of the ball also enables the erected carton to provide flat surfaces to accommodate multiple stackings, both during shipment and at the point of purchase.

The subject invention also provides a single blank for the display carton, and as is well known, blanks for such cartons are produced by mass production techniques in which literally hundreds of thousands of a particular blank design may be produced in a single production run. Therefore, it becomes economically important that the blanks be formed in a manner which will provide a final display carton which displays the item being held in a manner as desired while at the same time the carton presents sufficient regidity for handling after the article has been inserted into the carton. The subject invention provides a carton blank for achieving these objectives, and furthermore, provides that the handling and the erection of the subject carton blank prior to insertion of the article being displayed, can be carried out on existing packaging machinery. With the foregoing and additional objects in view, this invention will now be described in more detail, and other objects and advantages will be apparent in the following description, the accompanying drawings, and the appended claims.

Figure 1:
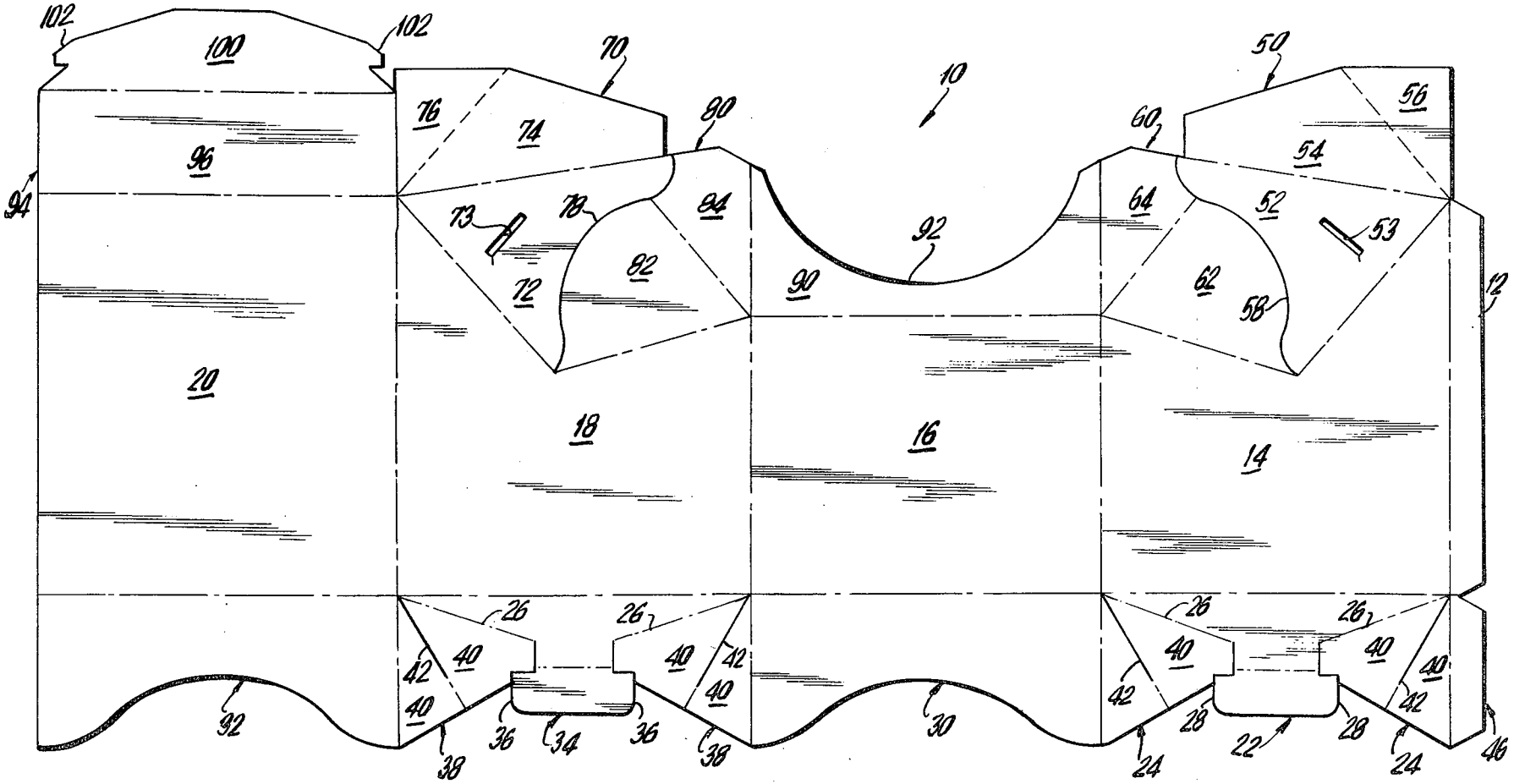
FIG. 1 is a plan view of a blank from which a display carton may be formed and embodying aspects for practicing the subject invention.

A carton blank for erecting a display carton in accordance with the subject invention is indicated generally at 10 in FIG. 1. Blank 10 is comprised of flexible sheet material such as paperboard, as is well known, and includes consecutively articulated glue tab 12, first side panel 14, top panel 16, second side panel 18, and bottom panel 20. Articulated to the opposite edges of panels 14 through 20, are the flap portions which define the partial front and rear panels of the display carton, as more fully described hereinafter.

Figure 7:
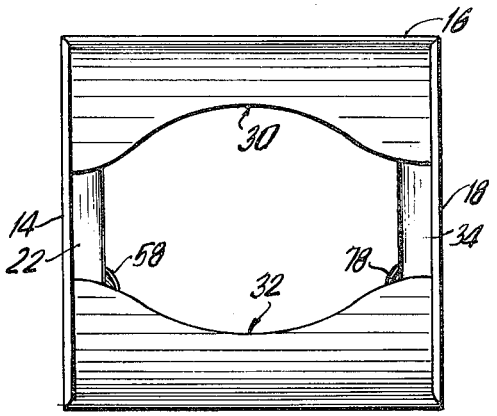
FIG. 7 is a rear elevational view of the display carton.
Figure 8:
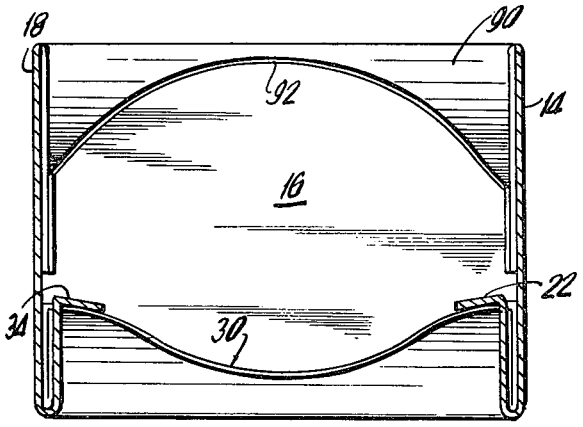
FIG. 8 is a sectional view taken along line 8—8 in FIG. 2.
Figure 9:
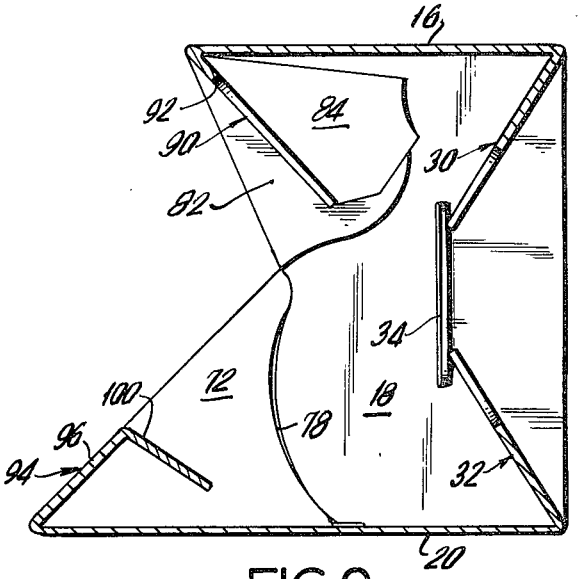
FIG. 9 is a sectional view taken along line 9—9 in FIG. 2.

Adhered to one end of the first side panel 14 is a lock tab 22 to which is articulated opposed webbed corners 24, 24. The webbed corners are articulated to the lock tab 22 along fold lines 26, 26, and the lock tab 22 includes flange portions 28, 28 which engage the ends of the concavely curved back portions 30, 32, respectively articulated to the top panel 16 and the bottom panel 20. In like manner, the second side panel 18 also includes a lock tab 34 including flanges 36, 36, and articulated to intermediate webbed corners 38, 38. In the erected position of the carton, the flanges 28, 36 of the lock tabs 22 and 34 engage the sinusoidal curved or concavely curved back portions 30 and 32, as illustrated more particularly in the sectional view of FIG. 9. The resulting back panel provides a peripheral support for the basketball, with the peripheral support being defined by the edges of the articulated back portions of the carton blank, as more distinctly shown in FIG. 7.

Each of the webbed corners 24 and 38 includes two triangular shaped segments 40 that have an intermediate articulation fold line 42, with the webbed corners being foldable inwardly, during erection, to provide a portion of the suspended and cushioned support for the back portion of the article to be accommodated in the display carton.

It should be understood that it is within the perview of this invention that the specially curved back portions 30 and 32 can be of other curved designs for accommodating different configured articles to be displayed, such as a football.

Articulated to one webbed corner 24 extending from the first side panel 14 is a glue tab 46 that, in the erected position of the carton, is secured to the back portion 32 articulated to the bottom panel 20. In like manner, the glue tab 12 is intended to be secured to the bottom panel 20 when the carton is erected.

Extending from the opposite side of the first side panel 14 and articulated thereto is a first cushion flap 50 defined by three triangular shaped articulated portions 52, 54 and 56, with the portion 52 including a curved edge 58 that is suitably designed for engaging the arcuate surface of the basketball. Also extending from the first side panel 14 is a second cushion flap 60 defined by two generally triangular shaped portions 62 and 64, each of which includes a curved edge contiguous with edge 58 that is adapted to engage the arcuate article to be displayed, and aid in the suspension of said article within the erected carton blank. Portion 52 of the first cushion flap 50 includes a locking aperture 53 which is adapted to accommodate a locking flange of the locking panel portion 100, as more fully described hereinafter.

Of similar construction are the cushion flaps 70 and 80 articulated to and extending from the second side panel 18. First cushion flap 70 includes articulated shaped portions 72, 74, and 76 with portion 72 including a curved edge 78 for engaging the arcuate surface of the article. Portion 72 also includes a locking aperture 73. Second cushion flap 80 is comprised of two generally triangular portions 82 and 84, having a curved edge contiguous with edge 78 for forming the angle for the front suspension.

Figure 2:
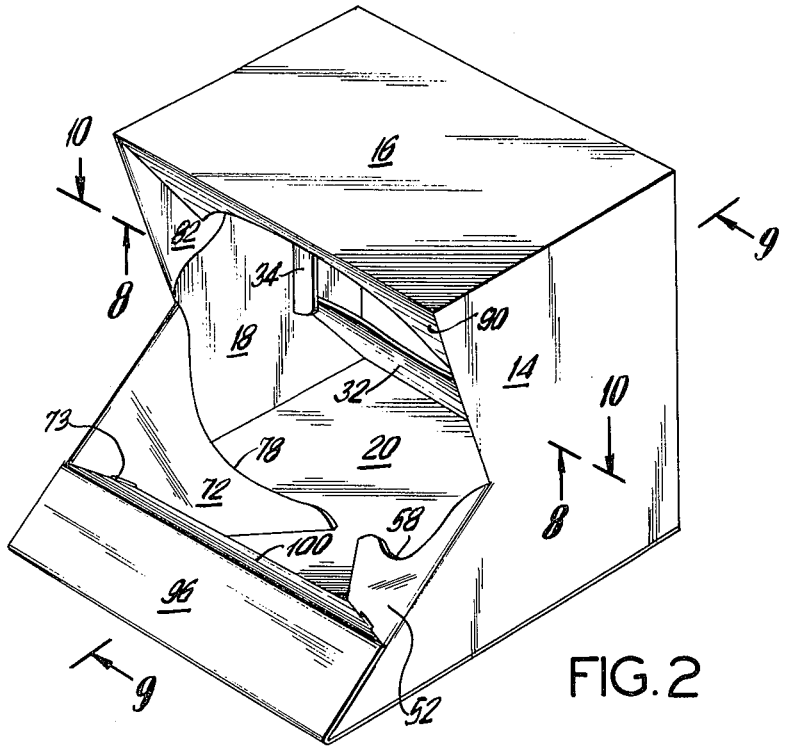
FIG. 2 is a perspective view of the erected display carton according to the subject invention.
Figure 3:
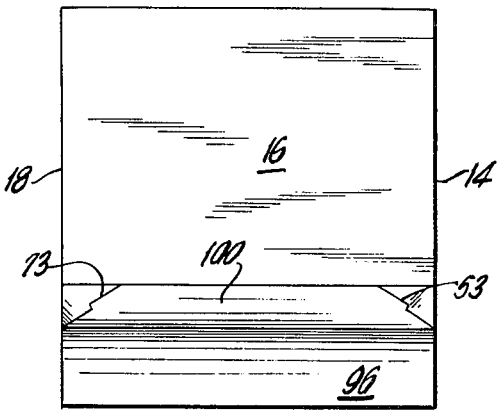
FIG. 3 is a plan view of the display carton of the subject invention.
Figure 5:
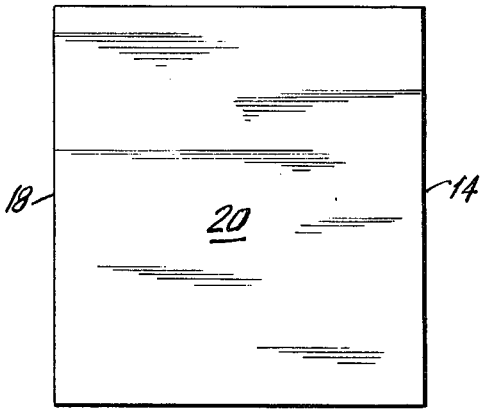
FIG. 5 is a bottom view of the display carton.
Figure 4:
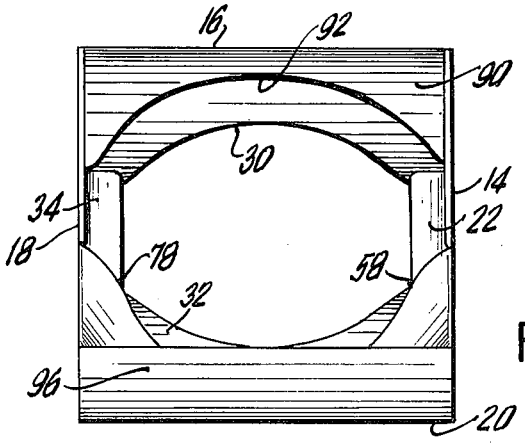
FIG. 4 is a front elevational view of the display carton.
Figure 6:
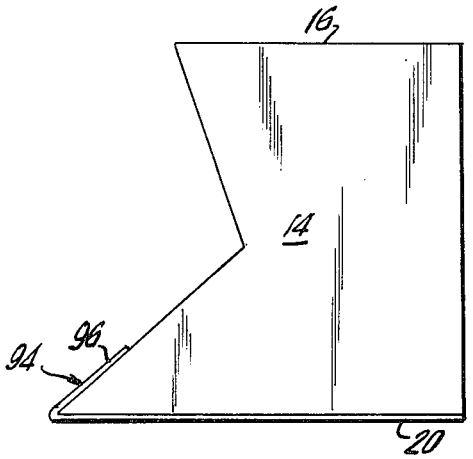
FIG. 6 is a side elevational view of the display carton.

Disposed at the front end of the erected carton (see FIGS. 2, 4, and 9), and articulated from the top panel 16 is a concavely curved front portion 90 including a curved edge 92 for engaging the arcuate surface of the article to be displayed. Panel 90 is also articulated to the portions 64 and 84 of the cushion flaps 60 and 80.

Figure 11:
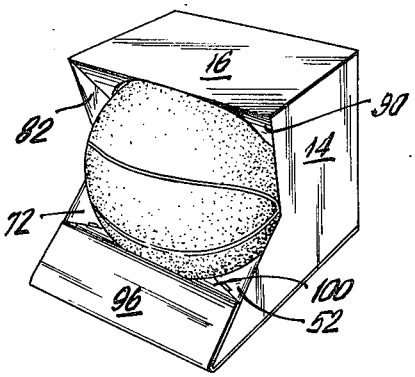
FIG. 11 is a perspective view of the display carton containing a basketball.

Forming the lower front portion of the erected carton of the subject invention (see FIGS. 2, 4, 6 and 9) is the lower front panel 94 which is articulated to the bottom panel 20 and includes display panel portion 96 and locking panel portion 100. The latter includes locking tabs or flanges 102 for engaging the aperatures 53 and 73, at which time the erected front panel 94 partially supports the article and the display panel portion 96 provides a surface for advertising material and the like. (see FIG. 11).

Referring more particularly to FIGS. 2 through 11, the erected carton provides good visibility of the article (see FIG. 11) and also enables multi-stacking at the display point of purchase. At the back of the carton (see FIGS. 2, 7, 9, and 10) the inwardly folded webbed corners 24 and 38 hold the curved back portions 30 and 32 at set angles (see FIG. 9) to create friction on the back of the article, such as a basketball, and assist in the suspension of the article and prevent turning of the article. Due to the shape of the curved back panels portions 30 and 32, visibility of the back of the article is provided (see FIG. 7). As indicated above, the lock tabs 34 engage the curved back panel portions 30 and 32 and thus maintain the webbed corners 24 and 38 firmly in place.

Considering the front of the erected carton, as more particularly illustrated in FIGS. 2, 3, 4, 6, 9, 10, and 11, it is noted that the top front panel 90 is folded inwardly and is articulated to cushion flaps 60 and 80 which assist in forming a set angle for the proper front top panel 90 of the carton. This angle and shape of the panel 90 is most important for providing visibility, and the curved edge 92 of the front panel portion 90 acts in conjunction with the curved edges of the articulated cushion flaps 60 and 80 to aid in the suspension of the article, as well as imparting friction thereto so as to prevent movement of the article within the erected carton. Further, because of the inwardly folded configuration of the combination of the front panel portion 90 and the articulated cushion flaps 60 and 80, the combination is capable of accomodating to changes in the diameter of the article supported by the carton in order to maintain and firmly hold the article within the carton. This is of particular importance with respect to inflatable articles, which may remain on a display shelf for extended periods of time, and which may experience a loss of inflation thereby decreasing the diameter of the article. Because of the fact that the combination is merely folded inwardly, and not locked into place, this combination can automatically adjust to compensate for variations in the diameter of the basketball.

Figure 10:
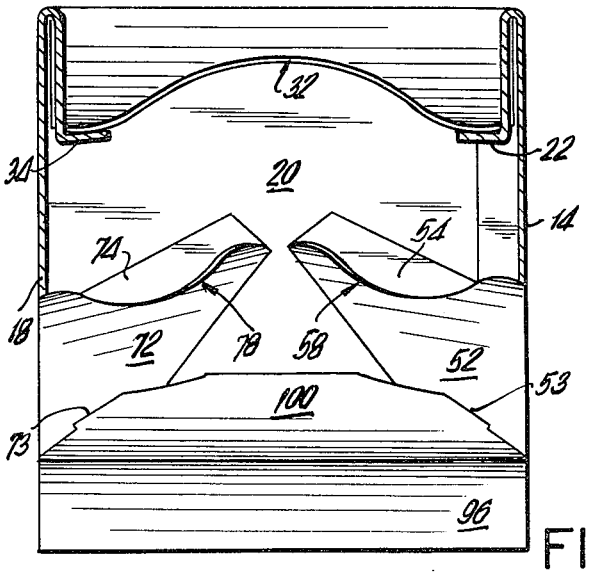
FIG. 10 is a sectional view taken along line 10—10 in FIG. 2.

The base of the front of the erected carton is defined by the combination of the folded lower front panel 94 and the inwardly folded cushion flaps 50 and 70, with the curved edges 58 and 78, as well as the edge of the display panel portion 96 providing a cushion support for the article. The curved edges 58 and 78 assist in nestling and providing friction to keep the product from turning. As shown in FIG. 10, the complete folding of the panel portions 52–54–56 and 72–74–76 form pyramid shaped structures which support the curved edges 58 and 78, and prevent the flaps 50 and 70 from thus collapsing or disengaging after the carton is set up with the product, as may be occasioned by rough handling or tumbling of the carton. To maintain the pyramid shaped structures of the cushion flaps 50 and 70, the lock tabs 102 of locking panel 100 engage and lock into the aperatures 53 and 73. It is noted that the primary support for the article is provided by the curved edges 58 and 78, the curved edge 92, and the curved back portions 30 and 32. (see FIG. 8).

As indicated above, the lower front panel 94 includes the display panel portion 96 that is part of the final closure and provides a large area for graphics such as advertising material and the like.

As indicated in FIG. 1, each of the aperatures 53 and 73 has a short cut slot to assist in the insertion of the locking tabs 102. After the tabs 102 are completely inserted, the cut slots in apertures 53 and 73 are for ease in inserting over-sized lock and to prevent the lock tabs from coming out.

In summary, there is provided a new and improved carton for shipping and displaying an article, such as an inflatable basketball. The erected carton provides protection during shipment, and enables good visibility of the product at the point of purchase, as well as multi-stacking of the cartons. Visibility of the product is afforded from both the front and the rear of the carton, and because of the arrangement of the internal cushion flaps within the subject carton, suspension of the article is achieved, and the article is maintained in a fixed position through frictional contact of the various inwardly tucked cushion flaps. The latter are capable of supporting different sized articles, such as basketballs of different quality construction which, when inflated to the same pressure, may have different diameters. Furthermore, flaps 22 and 34 are effective in providing frictional contact on the ball to aid in preventing rotation of the ball within the box. In addition, the disposition of the flaps 22 and 34 also acts to reinforce the resulting erected structure of the carton. The erected carton also provides an esthetically pleasing construction, has flat surfaces for enabling the multi-stacking of cartons, and provides a large area for advertising graphics and the like. In addition, the area of the upper panel 16 (see FIG. 3) is less than the area of the bottom panel 20 (see FIGS. 1, 3 and 5) whereby the front plane of the erected carton is inclined rearwardly so as to increase the visibility or exposure of the article.

The final erected carton has the substantial rigidity necessary for subsequent handling and, because of the relative ease of erection, making of the invention, in accordance herewith is highly advantageous commercially.

While the carton and blank herein disclosed form preferred embodiments of this invention, this invention is not limited to those specific embodiments, and changes can be made therein without departing from the scope of this invention which is defined in the appended claims.

What is claimed is:

1. A one-piece paperboard blank for erection into an article shipping and display carton comprising consecutively articulated glue tab, first side, top, second side, and bottom panels, said top and bottom panels each having two opposed ends, with said top and bottom panels each including curved back panels respectively articulated to one end thereof, while said first and second side panels include lock tab panels, with said curved back panels and said lock tab panels being interconnected by intermediate articulated webbed corners which are bent inwardly upon erection of the carton to define an open back portion of the carton wherein the edge portions of said curved back panels engage said article;

said top panel further including, at the opposite end thereof, an articulated upper front panel which is concavely curved with respect to said top panel;

said first and second side panels having two opposed ends, with said first and second side panels each including, at one end thereof, articulated pairs of cushion flaps which are bent inwardly upon erection of the carton and include curved edges for engaging said article; and said bottom panel including, at the opposite end thereof, an articulated lower front panel having a locking panel which upon erection of the carton, cooperates with portions of said pairs of said cushion flaps to define a lower display surface that is spaced from said concavely curved upper front panel to define an open front portion of the carton.

2. A one-piece paperboard blank for erection into an article shipping and display carton as in claim 1 wherein said curved back panels articulated from said top and bottom panels are concavely sinusoidal in configuration, with reference to said top and bottom panels.

3. A one-piece paperboard blank for erection into an article shipping and display carton as in claim 1 wherein each pair of cushion flaps includes two portions having a contiguous curved edge which engages the article, with one of said cushion flaps including a locking aperature for engagment with said locking panel.

4. A one-piece paperboard blank for erection into an article shipping and display carton as in claim 3 wherein said one of said cushion flaps includes three articulated segments that are generally triangular in configuration and are inwardly foldable when the carton is erected to define generally pyramidal supports for the article.

5. A one-piece paperboard blank for erection into an article shipping and display carton as in claim 1 wherein said articulated lower front panel includes a display surface articulated to the bottom panel, with the locking panel articulated to the display surface and including locking flanges.

6. A one-piece paperboard blank for erection into an article shipping and display carton as in claim 1 wherein each of said intermediate webbed corners includes two articulated generally triangular segments.

7. A one-piece paperboard blank for erection into an article shipping and display carton as in claim 3 wherein each contiguous curved edge is generally sinusoidal in configuration.

8. In a carton for display packaging of an article wherein two opposed surfaces of the article are exposed, said carton comprising a pair of side panels, top and bottom panels, an open front panel, and an open rear panel, said rear panel defined by: (1) two opposed back portions articulated respectively from said top and bottom panels, each portion being concavely curved relative to said respective top and bottom panel; (2) two pairs of webbed corner panels articulated respectively from said side panels; and (3) lock tab panels articulated respectively from said side panels intermediate said webbed corner panels, said lock tab panels being interlocked with said concavely curved back portions and the webbed corner panels to provide a peripheral support for the article; and said front panel being defined by: (1) an upper front portion articulated from said top panel, said upper front portion being concavely curved with respect to said front panel; (2) a first pair of cushion flap portions articulated from said side panels and said front portions; (3) a foldable lower display surface articulated from said bottom panel; and (4) a second pair of cushion flap portions articulated from said side panels and said foldable lower display surface, said upper front panel and said first and second cushion flap portions operative to provide a peripheral support for the article.

9. In a carton for display packaging of an article as in claim 8 wherein each of said second pair of cushion flap portions includes an aperture, and wherein said foldable lower display surface includes locking tab which engage said apertures.

10. In a carton for display packaging of an article as in claim 8 wherein said first and second pairs of cushion flap portions include arcuate edges which are disposed within the confines of the carton for engaging the surface of the article.

11. In a carton for display packaging of an article as in claim 8 wherein said first pair of cushion flap portions are inherently biased toward engagement with the article so as to maintain contact with said article upon variation in the size thereof.

* * * * *